US008746319B1

(12) United States Patent
Qayyeumi et al.

(10) Patent No.: US 8,746,319 B1
(45) Date of Patent: Jun. 10, 2014

(54) SPLIT VERTICAL WINDOW BLIND

(76) Inventors: Abdul W. Qayyeumi, Mississauga (CA); Masoud Qayyeumi, Mississauga (CA)

( * ) Notice: Subject to any disclaimer, the term of this patent is extended or adjusted under 35 U.S.C. 154(b) by 96 days.

(21) Appl. No.: 12/861,321

(22) Filed: Aug. 23, 2010

(51) Int. Cl.
*E06B 3/48* (2006.01)

(52) U.S. Cl.
USPC ..... 160/115; 160/168.1 V; 160/176.1 V; 160/177 V

(58) Field of Classification Search
USPC ..... 160/115, 168.1 V, 178.1 V, 176.1 V, 160/177 V, 173 V, 900; 248/354.4, 222.14, 248/413
See application file for complete search history.

(56) References Cited

U.S. PATENT DOCUMENTS

| | | | | | |
|---|---|---|---|---|---|
| 1,095,292 | A | * | 5/1914 | Smith | 160/172 R |
| 1,230,271 | A | * | 6/1917 | Brueggeman | 160/332 |
| 2,188,575 | A | * | 1/1940 | McLennan | 160/118 |
| 2,514,816 | A | * | 7/1950 | Wertz | 40/603 |
| 2,554,599 | A | * | 5/1951 | Stovern | 108/8 |
| 2,572,928 | A | * | 10/1951 | Hawes | 182/182.2 |
| 2,607,553 | A | * | 8/1952 | Garrett | 248/476 |
| 2,683,615 | A | * | 7/1954 | Holt | 403/362 |
| 2,882,563 | A | | 4/1959 | McCormick | |
| 3,134,428 | A | | 5/1964 | Kehrer et al. | |
| 3,455,364 | A | * | 7/1969 | Isamu | 160/172 R |
| 4,353,404 | A | * | 10/1982 | Trantow | 160/236 |
| 4,533,108 | A | * | 8/1985 | Willer et al. | 248/467 |
| 4,628,981 | A | * | 12/1986 | Ciriaci et al. | 160/176.1 V |
| 4,657,061 | A | * | 4/1987 | Meier | 160/176.1 V |
| 4,940,070 | A | | 7/1990 | Warden | |
| 5,105,870 | A | * | 4/1992 | Merjane | 160/236 |
| 5,139,071 | A | * | 8/1992 | Danchulis | 160/115 |
| 5,168,913 | A | * | 12/1992 | Haines | 160/168.1 R |
| 5,249,617 | A | | 10/1993 | Dürig | |
| 5,699,846 | A | * | 12/1997 | Ohanesian | 160/118 |
| 5,845,693 | A | * | 12/1998 | Cain | 160/168.1 V |
| 5,845,694 | A | | 12/1998 | Cohen | |
| 5,937,928 | A | * | 8/1999 | Chou | 160/168.1 V |
| 6,189,595 | B1 | * | 2/2001 | Lee | 160/168.1 R |
| 6,290,192 | B1 | * | 9/2001 | Messerli | 248/188.5 |
| 6,561,251 | B1 | * | 5/2003 | Prosch | 160/115 |
| 7,252,273 | B2 | * | 8/2007 | Lewellen et al. | 248/300 |
| 2009/0126881 | A1 | * | 5/2009 | Chi et al. | 160/368.1 |

* cited by examiner

*Primary Examiner* — Katherine Mitchell
*Assistant Examiner* — Johnnie A Shablack
(74) *Attorney, Agent, or Firm* — Robert C. Montgomery; Montgomery Patent & Design

(57) ABSTRACT

A vertical window blind apparatus that enables lateral and angular operation of multiple two-piece slat assemblies comprises a control rod that manipulates vertical slats while allowing a user to select a relative angle between upper and lower portions of each slat assembly. In this manner, the slats at the top of the window can be securely angled to let light in, while the slots at the bottom can be kept closed for privacy. Additionally, the upper and lower halves of the slat assembly may be arranged in a coplanar manner, thereby allowing similar operation as common blinds having one-piece slats.

18 Claims, 7 Drawing Sheets

SPLIT VERTICAL WINDOW BLIND

RELATED APPLICATIONS

The present invention was first described in a notarized Official Record of Invention on Mar. 23, 2009, that is on file at the offices of Montgomery Patent and Design, LLC, the entire disclosures of which are incorporated herein by reference.

FIELD OF THE INVENTION

The present invention relates generally to window blinds, and in particular, to a window blind assembly with provisions for separately adjusting the angle of different portions of the blind for greater customizability in lighting and privacy conditions.

BACKGROUND OF THE INVENTION

Windows are a ubiquitous fixture found on nearly every building structure. Windows allow for many desirable features such as a view of the outdoors, easy temporary opening means for allowing a breeze to enter indoors or the like, natural lighting means during daytime conditions, and many other desirable uses. One (1) problem commonly associated with windows is that users on the interior of the building do not always wish to allow sunlight indoors, such as is common when attempting to prevent a glare on a television or the like, and such users also desire privacy from outside viewing on frequent occasion.

Blinds including both traditional horizontal Venetian blinds and louver style vertical blinds represent a common solution to providing selective, temporary open and closed viewing through windows and the like. Such blinds generally comprise a plurality of thin rectangular sections which are selectively rotated by a user in order to allow a desired angle or percentage of viewing and light passage through the window portion. Other common features and devices include provisions for selectively collapsing the device out of the way of the window entirely and provisions for restoring it to its position when desired for use. Examples include curtains which are drawn and tied in a side position and released when cover for the window is desired, as well as tracks which allow for the horizontal movement and gathering of vertical blinds, etc.

One (1) problem associated with such window covering methods is that in many cases the method entails a unitary angle or covering state for the device as a whole. In other words, a curtain is generally closed or opened and the window is provided with either a lack of viewing and lighting, or such viewing and lighting is allowed. The individual slats of blinds rotate at a unitary angle and the such, meaning that all portions of the window admit equal portions of light. In situations where plural lighting conditions are desirable, users are forced to compromise. For instance, in a room with a television, the incident angle of light from the sun may necessitate blockage of the light in order to successfully view the television; however, such blockage of light leaves the remainder of the room in darkness. In other cases, it is desirable to prevent ground level viewing of the interior of a building for privacy purposes, although it is still desirable to provide natural light to the interior of the room.

Various attempts have been made to provide selective window covering devices. Examples of these attempts can be seen by reference to several U.S. patents. U.S. Pat. No. 4,628,981, issued in the name of Ciriaci et al., describes a prototypical vertical blind assembly including a track for horizontal positioning of the individual blinds and a geared rotating mechanism for providing a desired angle to the slats.

U.S. Pat. No. 4,940,070, issued in the name of Warden, describes a horizontal Venetian style blind with a second drawstring threaded in a desired position which allows a user to provide an increased angle to the blinds above said position.

U.S. Pat. No. 5,699,846, issued in the name of Ohanesian, describes a split vertical blind headrail which provides pair of vertical blind assemblies which may be separately outwardly moved from the center of the rail, providing unfettered lighting and viewing through the central separation.

U.S. Pat. No. 5,845,694, issued in the name of Cohen, describes horizontal Venetian blind assembly wherein each horizontal blind is individually horizontally adjustable to fit a desired opening or in order to provide selective lighting around the edges of the blind assembly.

While these devices fulfill their respective, particular objectives, each of these references suffer from one (1) or more of the aforementioned disadvantages. Many such devices are not functional as conventional blind assemblies. Also, many such devices do not provide features of separable adjustability. Furthermore, many such devices do not allow for an infinite range of relative adjustability between these differing portions of the device. In addition, many such devices are not able to replace an existing conventional blind assembly. Accordingly, there exists a need for a window blind without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a retrofittable window blind assembly with features of separable adjustability to various portions of the assembly which allows for a wide range of partially open, partially closed configurations for a range of common situations such that the assembly can still be utilized in a familiar and conventional manner. Thus, the object of the present invention is to solve the aforementioned disadvantages and provide for this need.

To achieve the above objectives, it is an object of the present invention to comprise a conventional vertical blind assembly and provide associated features. The apparatus is compatible with a common window opening.

Another object of the present invention is to enable independent rotated positioning of upper and lower portions of the apparatus. The apparatus comprises a plurality of parallel vertical two-piece slat assemblies comprising separate upper and lower slat portions.

Yet still another object of the present invention is to allow a user to selectively produce a desired privacy or lighting effect in a wide range of partial configurations via manual relative angle adjustment of the upper and lower slat portions.

Yet still another object of the present invention is to allow for use as a conventional vertical blind if so desired by adjusting all upper and lower slat portions to a flat, parallel configuration.

Yet still another object of the present invention is to provide stabile linear vertical support of both the upper and lower slat portions. The apparatus comprises a head rail assembly which provides attachment to the upper slat via a support rod fastener in a conventional manner. Each upper slat further connects to a support rod via a plurality of upper slat fasteners, which in turn supports a lower fastener, which provides rotating connection to a corresponding lower slat portion.

Yet still another object of the present invention is to provide conventional lateral sliding deployment of the slat assemblies and rotating capabilities via a gear-drive mechanism housed in the head rail assembly. The apparatus further comprises a control rod which allows a user to easily manipulate the sliding and rotating functions.

Yet still another object of the present invention is to provide a number of desirable configurations via manipulation of the relative angle of the slats and via rotation of the slat assemblies via the control rod. Such configurations include opening the upper half of the assembly while closing the bottom half in order to provide lighting and ground level viewing privacy, closing the top half while opening the bottom half in order to prevent glare or the like while still providing lighting, and conventional fully open or fully closed configurations.

Yet still another object of the present invention is to provide aesthetic and protective covering to the head rail assembly.

Yet still another object of the present invention is to provide a method of utilizing the device that provides a unique means of installing the head rail and slat assemblies in a desired window opening, selectively adjusting the relative angle of the upper and lower slat portions to provide a desired effect, laterally deploying or collapsing the apparatus via the control rod in a conventional manner, providing rotation to the upper slat portions via the control rod and gear mechanism, providing corresponding rotation to the lower slat portions via said motioning of the upper slat portions in order to achieve a desired position of the apparatus for a desired lighting effect, easily readjusting the relative angle between upper and lower slat portions for changing the provided lighting effect, and positioning each upper and lower slat portion in a planar position in order to allow the apparatus to function in the manner of a conventional vertical blind assembly.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
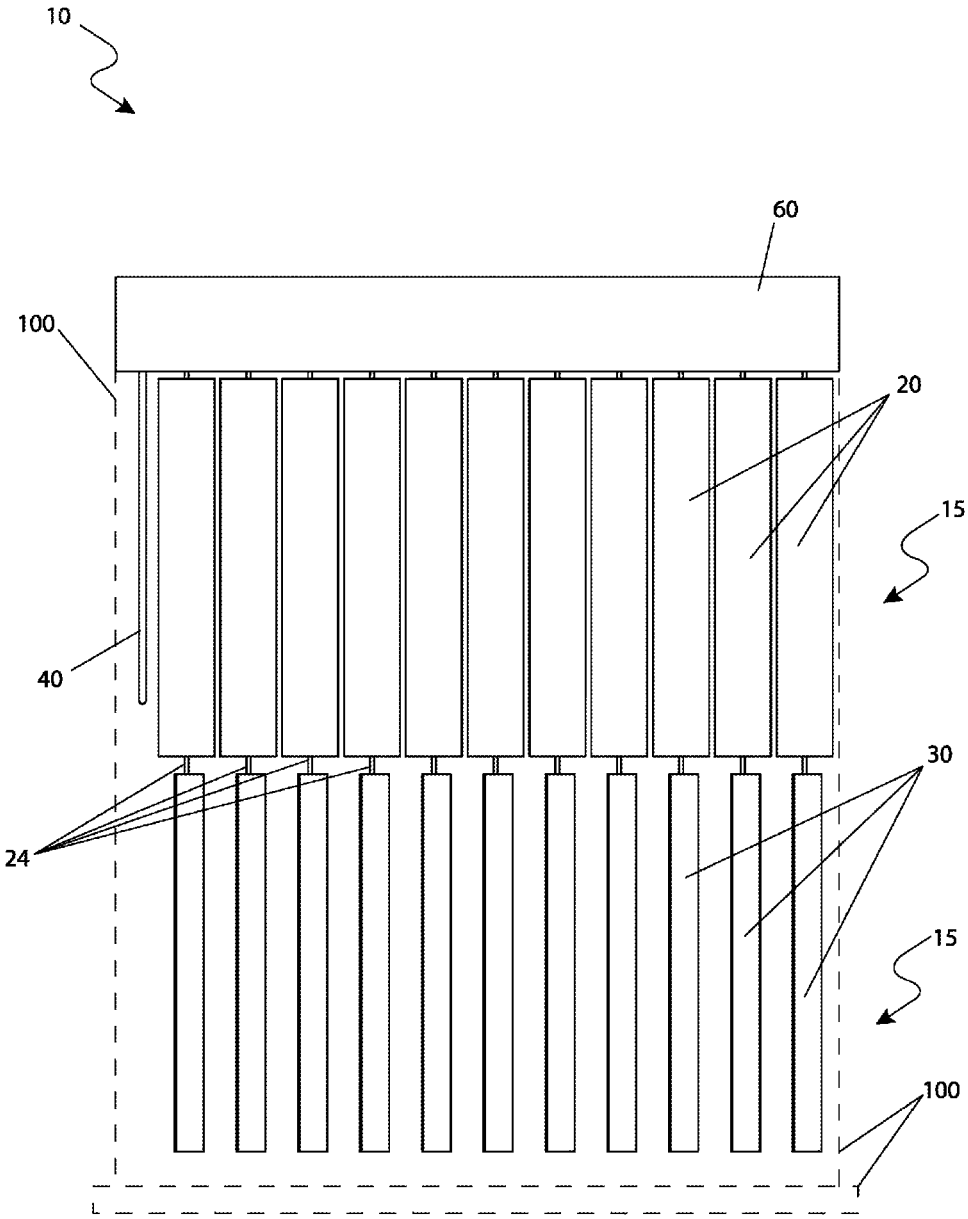
FIG. 1 is a front view of a split vertical window blind 10, according to a preferred embodiment of the present invention.

10 split vertical window blind
15 slat assembly
20 upper slat portion
22 support rod fastener
24 support rod
26 slat fastener aperture
28 upper slat fastener
29 strap fastener
30 lower slat portion
32 lower slat fastener
33 block aperture
34 tightening fastener
40 control rod
42 connection ring
50 head rail assembly
52 head rail frame
54 slider
55 slider fastener
56 slider rail
58 control rod slider
60 valence panel
100 window opening

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a split vertical window blind (herein described as the "apparatus") 10, which provides a vertical blind window covering which enables independent rotated positioning of upper and lower portions of vertical two-piece slat assemblies 15. In this manner, the upper slat portion 20 being positioned along a top portion of a window opening 100 can be adjustably angled to let light in, while the lower slat portion 30 being positioned along the bottom portion may be kept closed for privacy, or vice-versa.

Referring now to FIG. 1 is a front view of a split vertical window blind 10, according to a preferred embodiment of the present invention, is disclosed. The apparatus 10 is illustrated here being utilized within a common window opening 100 providing coincidental closed and open slat functions within said window opening 100. The apparatus 10 comprises a plurality of vertical slat assemblies 15 suspended in a parallel arrangement. Each slat assembly 15 further comprises an upper slat portion 20 which provides rotational attachment thereto a corresponding lower slat portion 30, thereby forming a vertically hung assembly 15 (see FIG. 2). Each slat portion 20, 30 comprises a linear panel having a slightly concaved profile and is envisioned to be made of extruded plastic being introduced in various colors and patterns to match a surrounding décor. Said upper 20 and lower 30 slat portions may be manually rotated relative thereto each other via a joining support rod 24 to produce various angles between based upon a desired privacy or lighting effect. It is further understood that said slat portions 20, 30 may be positioned in a coplanar manner so as to emulate a standard vertical blind if so desired.

Figure 2:
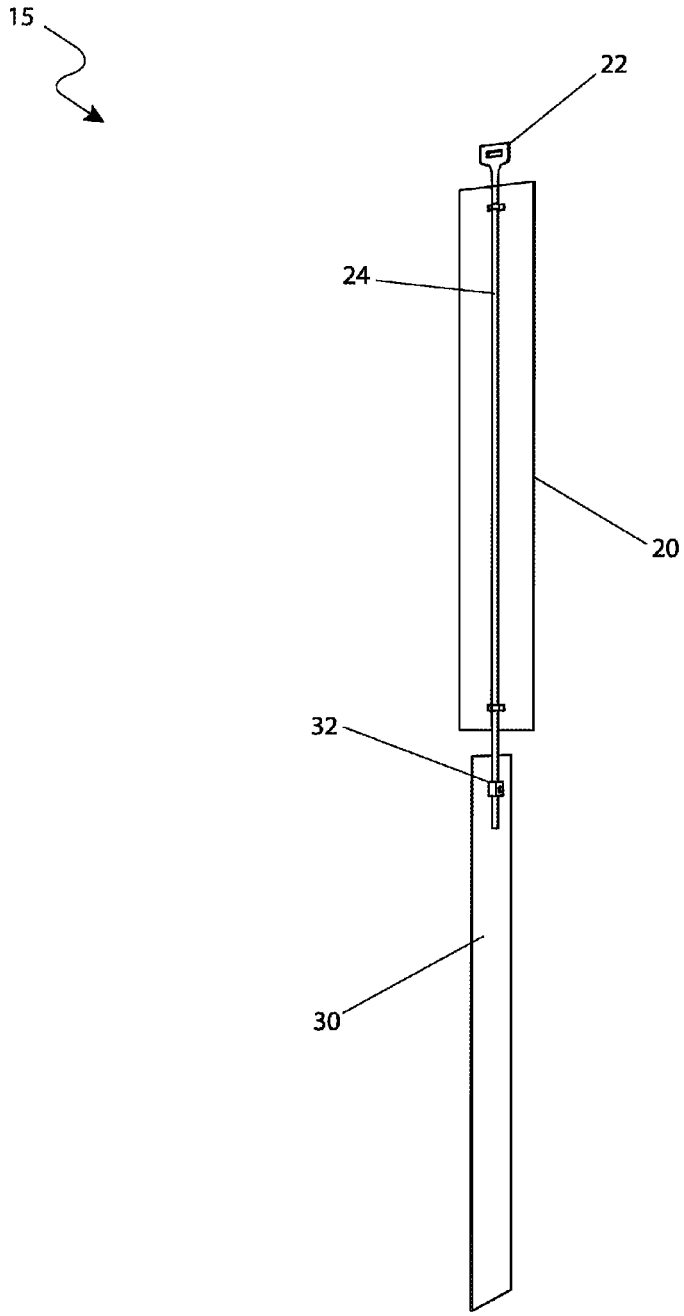
FIG. 2 is a rear perspective view of a slat assembly portion 15 of the split vertical window blind 10, according to a preferred embodiment of the present invention.

Referring now to FIG. 2, a perspective view of a slat portion 15 of the split vertical window blind 10, according to a preferred embodiment of the present invention, is disclosed. Each slat assembly 15 comprises a support rod fastener 22, a support rod 24, a plurality of upper slat fasteners 28, an upper slat portion 20, a lower slat fastener 32, and a lower slat portion 30.

The support rod fastener 22, support rod 24, and lower slat fastener 32 provide a linear vertical support structure between the slat portions 20, 30, and a head rail assembly 50, thereby stabilizing respective vertical positions thereof. The support rod fastener 22 provides an attachment means between the slat assembly 15 and the head rail assembly 50 (see FIGS. 4*a* and 4*b*). The support rod fastener 22 also provides an attachment means thereto the support rod 24, thereby providing a linear supporting link between the head rail assembly 50 and the lower slat portion 30. A plurality of upper slat fasteners 28 resiliently affixes the support rod 24 to each of said slats of said upper slat portion 20 along a longitudinal center line. The lower slat portion 30 is affixed thereto a bottom end portion of the support rod 24 via the lower slat fastener 32. The lower slat fastener 32 is affixed thereto a top edge region of the lower slat portion 30 and provides rotating insertion and fastening of the support rod 24 into, thereby allowing a user to select and secure a relative angle between the upper 20 and lower 30 slat portion (see FIG. 6).

Although illustrated here comprising separate pieces of the apparatus 10, any or all of the features and/or functions of the support rod fastener 22, the support rod 24, the plurality of upper slat fasteners 28, and the lower slat fastener 32 may be integrally incorporated into the upper 20 and lower 30 slat portions during an injection molding or extrusion process to reduce manufacturing costs.

Figures 3A, 3B:
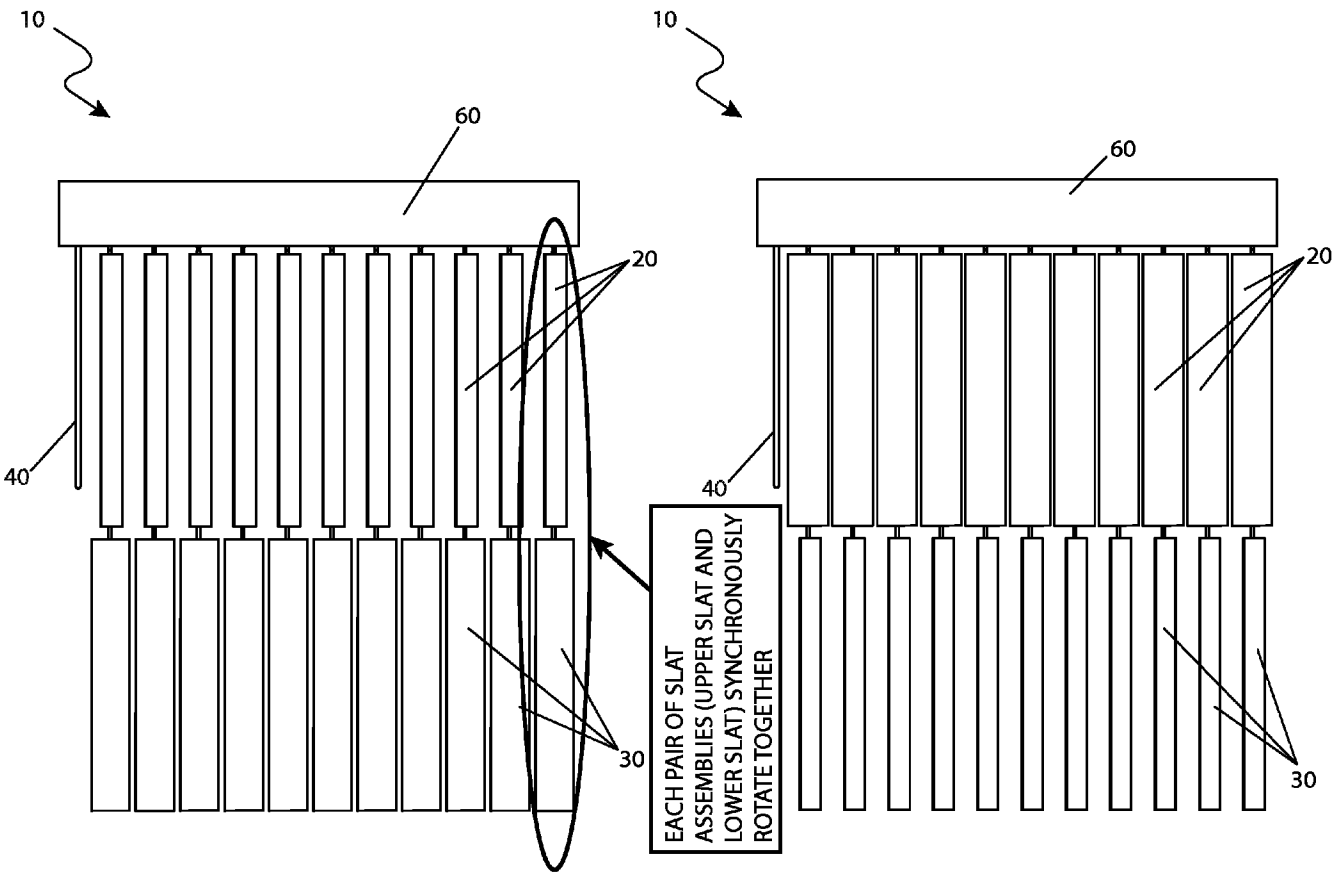
FIG. 3*a* is a front view of the split vertical window blind 10 depicting an open upper portion, according to a preferred embodiment of the present invention.
FIG. 3*b* is a front view of the split vertical window blind 10 depicting an open lower portion, according to a preferred embodiment of the present invention.

Referring now to FIGS. 3*a* and 3*b*, front views of the apparatus 10 depicting upper and lower open states, according to a preferred embodiment of the present invention, are disclosed. The apparatus 10 comprises a control rod 40 which provides conventional manipulating functionality to horizontally deploy and rotational position the slat portions 20, 30. Additionally, a user may manually rotate each lower slat portion 30, thereby creating a relative angle between said lower slat portion 30 and a respective upper slat portion 20. In this manner, the upper slat portion 20 being located at a top of the window, can be adjustably angled to let light in using the control rod 40 while the lower slat portion 30 located at the bottom of said window opening 100 can be kept closed for privacy. Conversely, the upper slat portion 20 may be adjustably angled to block light from the sun, while the lower slat portion 30 allows low-level light to enter a room if desired. Finally, the slat portions 20, 30 may be positioned in a coplanar manner so as jointly allow a maximum or minimum amount of light to pass through based upon a user's preference.

Figure 4A:
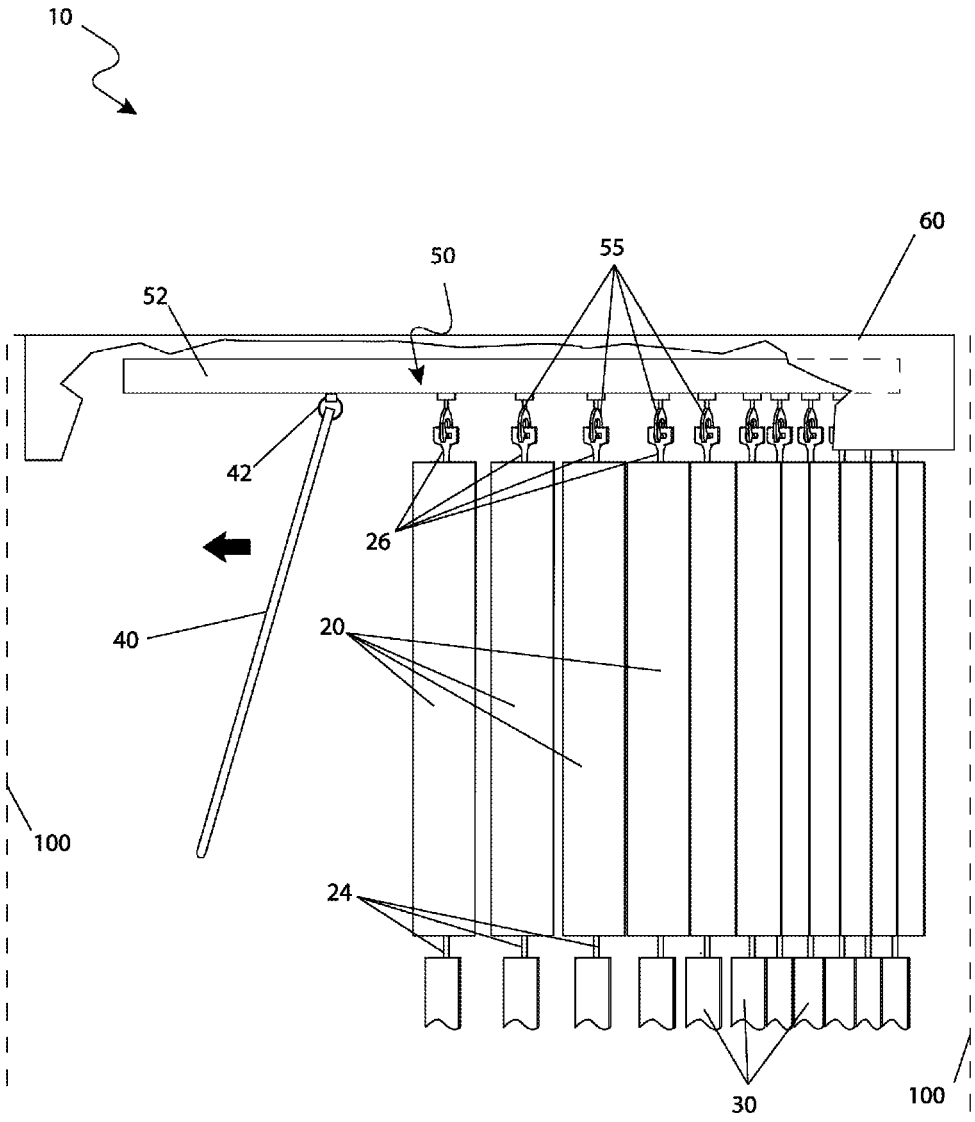
FIG. 4*a* is a front view of the split vertical window blind 10 depicting a partially deployed state, according to a preferred embodiment of the present invention.
Figure 4B:
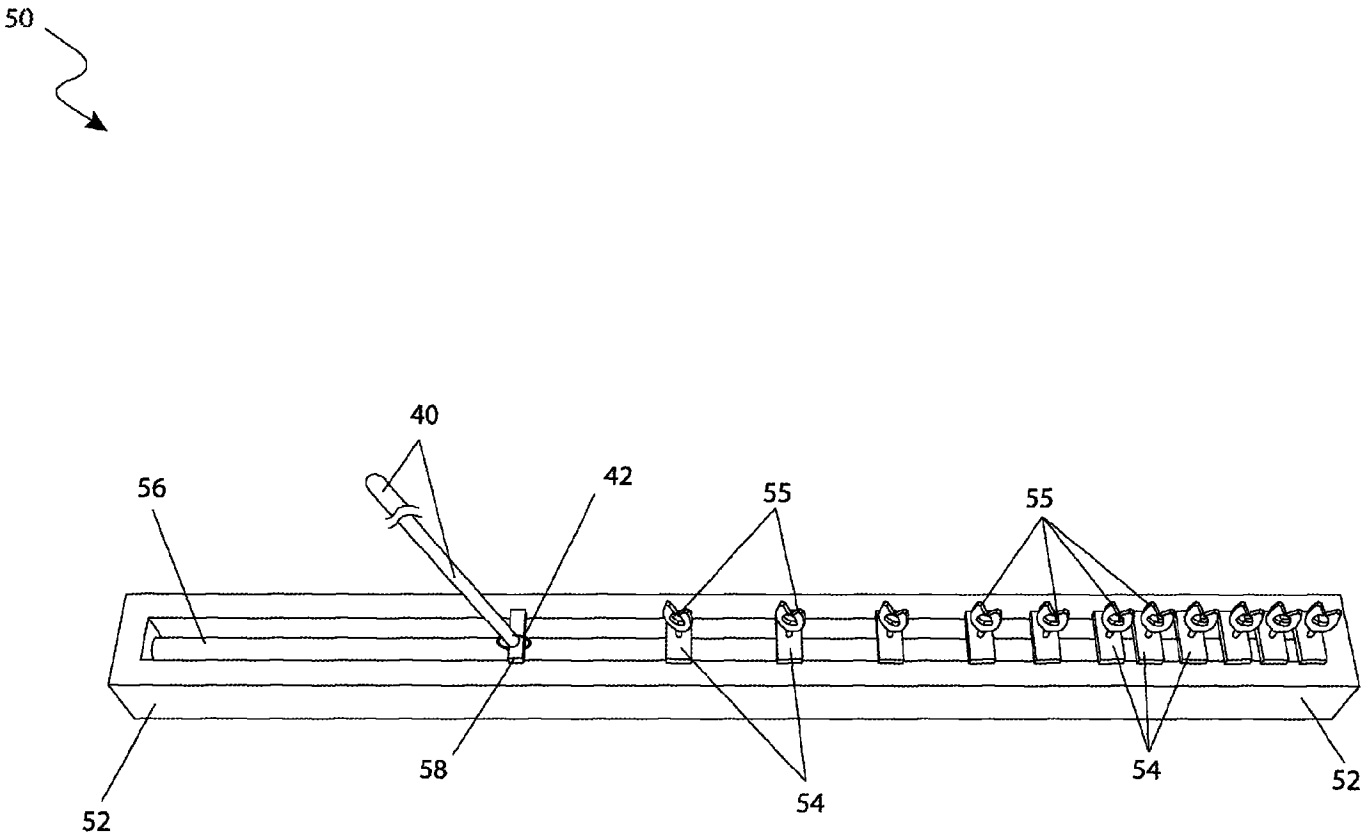
FIG. 4*b* is a perspective view of the split vertical window blind 10 depicting a head rail assembly portion 50, according to a preferred embodiment of the present invention.

Referring now to FIGS. 4*a* and 4*b*, various views of the head rail assembly portion 50 of the apparatus 10, according to a preferred embodiment of the present invention, are disclosed. The apparatus 10 comprises a head rail assembly 50 which works in conjunction with the aforementioned control rod 40 to provide conventional lateral sliding deployment of said slat assemblies 15 via a lateral drive mechanism, and a rotating function to said slat assemblies 15 via a miniature gear-drive mechanism in a similar manner as other blinder positioning mechanisms made by companies such as NOVO®, GRABER®, and BALI®, being common in the market. The head rail assembly 50 further comprises a head rail frame 52. The head rail frame 52 further comprises an elongated open-bottom rectangular enclosure providing decorative and protective containment of the components necessary to position the slat assemblies 15 across the window opening 100 including a plurality of sliders 54 which further comprise respective slider fasteners 55, a horizontal slider rail 56, and a control rod slider 58 which provides sliding attachment of the control rod 40 via a pivoting connecting ring 42.

Additionally, the apparatus 10 comprises a decorative valence panel 60 which provides an aesthetic flat vertical panel to discreetly cover the head rail assembly 50. The valance panel 60 is to be stationarily mounted to a top portion of the window opening 100 using common fasteners, brackets, or the like. Said valence panel 60 is to be introduced in various colors and pattern which coordinate with the slat assemblies 15 and the surrounding décor.

Figure 5:
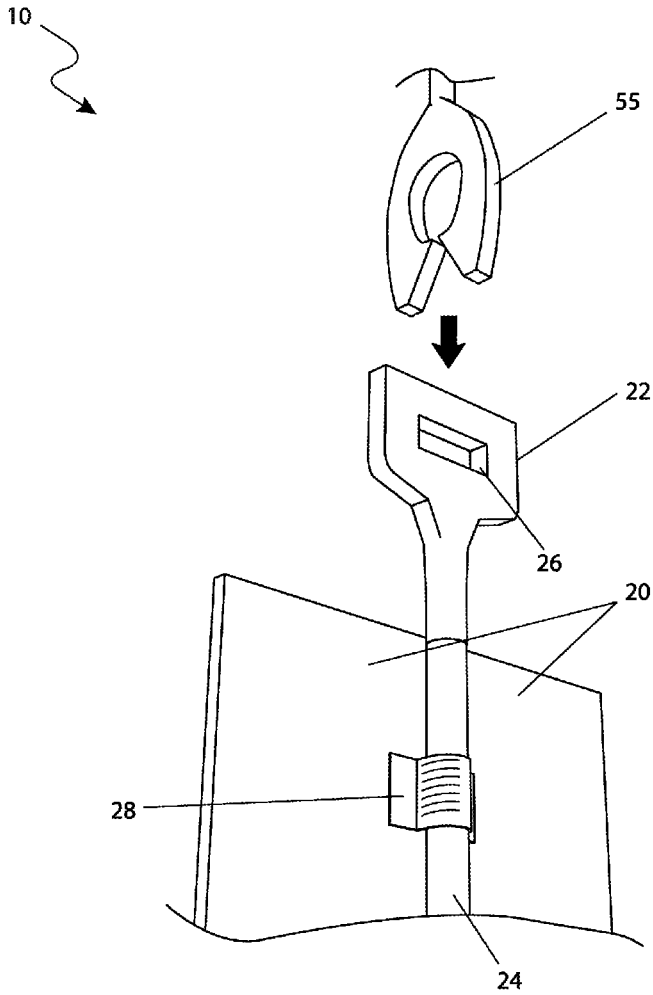
FIG. 5 is a perspective view of the split vertical window blind 10 depicting a means to attach an upper slat portion 20, according to a preferred embodiment of the present invention; and, FIG. 6 is a perspective view of the split vertical window blind 10 depicting a means to attach a lower slat portion 30, according to a preferred embodiment of the present invention.

Referring now to FIG. 5, a perspective view of the split vertical window blind 10 depicting a means to attach an upper slat portion 20, according to a preferred embodiment of the present invention, is disclosed. Each upper slat portion 20 comprises an upwardly extending support rod fastener 22 which provides a snapping mechanical connection thereto the slider fastener portion 55 of the head rail assembly 50 via engagement thereto a slat fastener aperture portion 26 of said support rod fastener 22. The support rod fastener 22 also provides an attachment thereto a support rod 24 using common joining methods such as swaging, plastic welding, adhesives, or equivalent joining methods. The support rod 24 extends downwardly along the upper slat portion 20 being rigidly affixed thereto top and bottom surfaces of said upper slat portion 20 via a pair of "U"-shaped strap fasteners 29 envisioned to be bonded thereto said upper slat portion 20 and said support rod 24 using common industrial adhesives.

It is understood that the features and functions of the support rod fastener 22, support rod 24, and the plurality of upper salt fasteners 28 may be integrally incorporated into the upper slat portion 20 as part of a plastic injection molding or extrusion process without deviating from the concept and as such should not be interpreted as a limiting factor of the apparatus 10.

Figure 6:
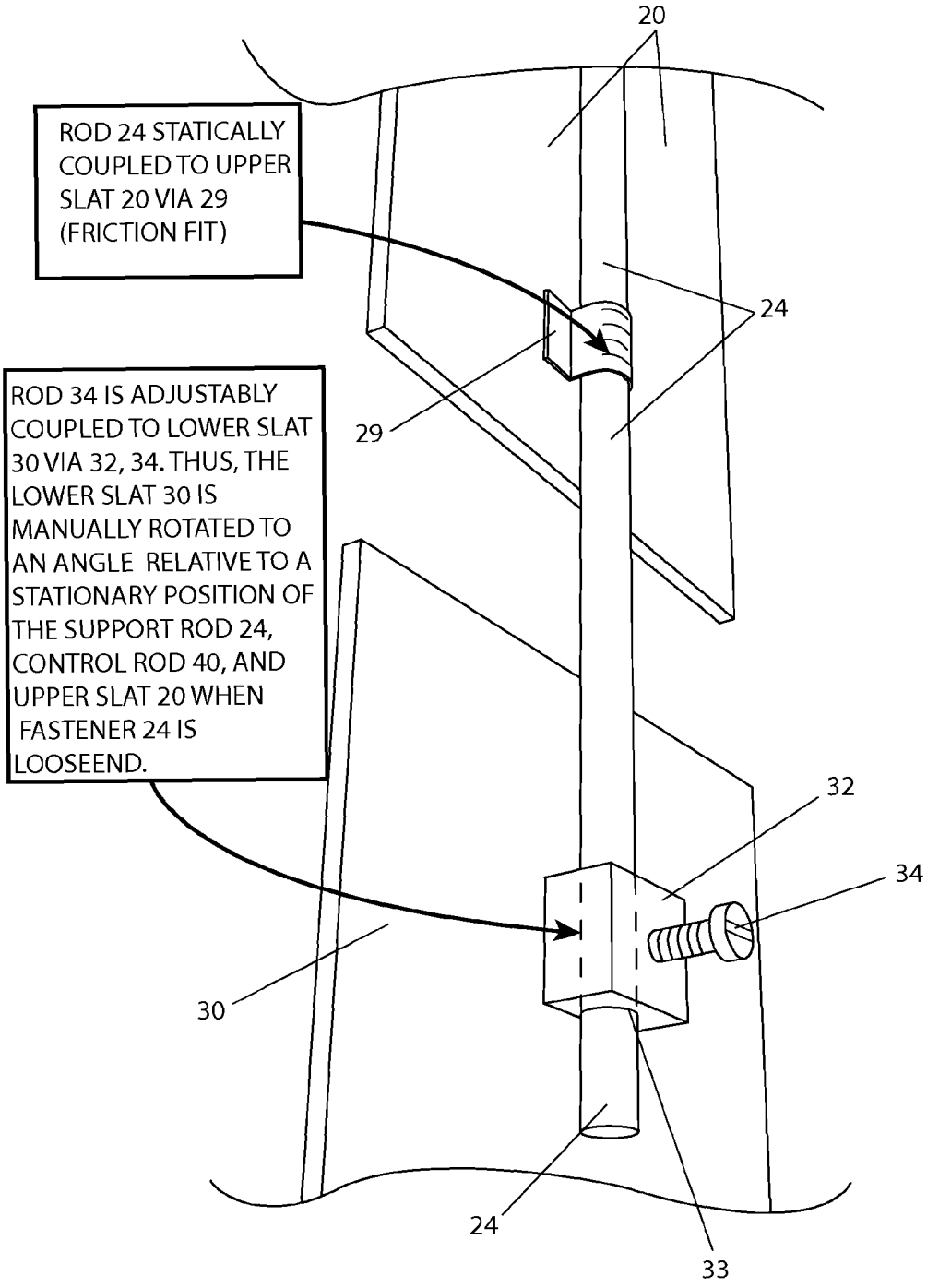

Referring now to FIG. 6, a perspective view of the split vertical window blind 10 depicting a means to attach a lower slat portion 30, according to a preferred embodiment of the present invention, is disclosed. The aforementioned support rod 24 extends downwardly beyond a bottom edge of the upper slat portion 20 and provides an attachment means thereto the lower slat portion 30 being slidingly inserted into the lower slat fastening block 32. The lower slat fastening block 32 comprises a rectangle-shaped member approximately one-half (½) of an inch square by approximately one-quarter (¼) inch thick further comprising a vertical block aperture 33 and a tightening fastener 34. Said support rod 24 is to be inserted into said block aperture 33 and secured using the tightening fastener 34. The lower slat fastening block 32 provides a means to select a relative angle between the upper 20 and lower 30 slat portions being manually positioned and secured in place using the tightening fastener 34.

It is understood that the features and functions of the support rod 24, the lower slat fastening block 32, the block aperture 33, and the tightening fastener 34 may be integrally incorporated into the lower slat portion 30 as part of a plastic injection molding or extrusion process without deviating from the concept and as such should not be interpreted as a limiting factor of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 through 6.

The method of installing and utilizing the apparatus 10 may be achieved by performing the following steps: procuring a particular model of the apparatus 10 having a width and height which corresponds thereto an anticipated window opening 100; attaching the head rail assembly 50 and valence panel 60 portions thereto said window opening 100 using provided common fasteners; installing the slat assemblies 15 by inserting the support rod fastener portions 22 of each slat assembly 15 into the corresponding slider fastener portions 55 of the head rail assembly 50; loosening the tightening fastener 34 on each slat assembly 15, thereby allowing rotation of the lower slat portion 30 to a desired relative angle with respect to the corresponding upper slat portion 20; retightening the tightening fastener 34 to secure the orientation of the lower slat portion 30; rotating the plurality of slat assemblies 15 in a synchronized fashion by twisting the control rod 40 in a conventional manner to provide desired privacy and/or lighting/shading effects; and, benefiting from increased versatility of lighting and shading afforded a user of the present apparatus 10.

An alternative embodiment of the apparatus 10 comprises integration of some or all of the features and functions of the support rod fasteners 22, the support rods 24, the plurality of upper slat fasteners 28, the support rods 24, the lower slat fastening blocks 32, the block apertures 33, and the tightening fasteners 34, into the respective lower 20 and upper 30 slat portions of the apparatus 10 by utilizing plastic injection and extrusion processes to reduce manufacturing costs.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A window covering, comprising:

a head rail assembly including a control rod;

a plurality of resilient support rods, each attached at an upper end to and operably controlled by said head rail assembly;

an upper slat assembly, comprising a plurality of upper slats each vertically suspended in a parallel arrangement and affixed to one of said plurality of support rods; and, a lower slat assembly subjacent to said upper slat assembly, comprising a plurality of lower slats each vertically suspended in a parallel arrangement and affixed to one of said plurality of support rods;

wherein said head rail assembly is affixed to a window casing such that said upper slat assembly is positioned along a top portion of a window opening and said lower slat assembly is positioned along a bottom portion of said window opening;

wherein said each of said support rods provides a linear vertical support to said upper slat assembly and said lower slat assembly;

wherein said upper slat assembly and said lower slat assembly form longitudinally aligned pairs of said upper and lower slats and each said longitudinally aligned pairs of upper and lower slats is independently operated via said head rail assembly and that within each said longitudinally aligned pairs of upper and lower slats, said upper and lower slats is synchronously rotated;

wherein, when each of said upper slats, said support rod and said control rod is held at a stationary position, said lower slats are manually routed to an angle relative to said upper slats and said upper slats remain stationary;

wherein said supports rods are directly engaged to an outer surface of each said longitudinally aligned pairs of upper and lower slats, respectively; and, wherein said support rods remain exposed exterior of said outer surface of each said longitudinally aligned pairs of upper and lower slats, respectively.

2. The window covering of claim 1, wherein each of said plurality of upper and lower slats further comprises a linear panel having a slightly concaved profile.

3. The window covering of claim 1, further comprising a decorative valence panel statically mounted above said window opening to cover said head rail assembly and a portion of said plurality of support rods.

4. The window covering of claim 1, wherein said each of said support rods is affixed to a rear side of each of said plurality of upper slats along a longitudinal center line thereof via a plurality of upper slat fasteners.

5. The window covering of claim 4, wherein each of said plurality of upper slat fasteners further comprises a capturing bracket.

6. The window covering of claim 1, wherein said each of said support rods is affixed to a rear side of each of said plurality of lower slats along a longitudinal center line thereof via a plurality of lower slat fasteners.

7. The window covering of claim 6, wherein said plurality of lower slat fasteners each further comprises a fastening block having a block aperture centrally located therethrough;

wherein each of said plurality of support rods are removably inserted within said block aperture with a fastener, thereby enabling rotary motion of each of said plurality of lower slats when driven by said each of said plurality of support rods; and, wherein a fastener secures each of said lower slats at a desired rotary position.

8. The window covering of claim 1, wherein said head rail assembly further comprises:

a head rail frame, comprising an elongated enclosure having an open bottom and a slider rail;

a control rod slider slidably engaged within said slider rail; said control rod connected to said control rod slider;

a gear drive mechanism operably controlled by said control rod slider;

a lateral drive mechanism operably controlled by said control rod slider;

a plurality of sliders slidably engaged within said slider rail and operably controlled by said lateral drive mechanism and said gear drive mechanism;

wherein said head rail frame is removably affixed to said window casing;

wherein said control rod provides a lateral sliding deployment of said plurality of support rods via said lateral drive mechanism;

wherein said control rod provides a rotating deployment of said plurality of support rods via said gear drive mechanism; and, wherein each of said plurality of support rods are removably attached to each of said plurality of sliders via a support rod fastening means, thereby operably connecting said control rod to said upper slat assembly and said lower slat assembly.

9. The window covering of claim 8, wherein said support rod fastening means further comprises:

a support rod fastener affixed to and upwardly extending from an upper terminal end of each of said plurality of support rods, further comprising a centrally disposed slat fastener aperture; and, a slider fastener downwardly extending from each of said plurality of sliders, further comprising a bifurcated pair of locking tabs;

wherein said slider fastener correspondingly mates with said support rod fastener, thereby mating each of said plurality of support rods to each of said plurality of sliders.

10. A window covering, comprising:

a head rail assembly;

a plurality of resilient support rods, each attached at an upper end to and operably controlled by said head rail assembly;

a plurality of upper slats each vertically suspended in a parallel arrangement and rotatably affixed to one of said plurality of support rods;

a plurality of lower slats subjacent to said plurality of upper slats, each vertically suspended in a parallel arrangement and rotatably affixed to one of said plurality of support rods; and, a decorative valence panel statically mounted above said window opening to cover said head rail assembly and a portion of said plurality of support rods;

wherein said head rail assembly is affixed to a window casing such that said plurality of upper slats are positioned along a top portion of a window opening and said plurality of lower slats are positioned along a bottom portion of said window opening;

wherein said each of said support rods provides a linear vertical support to each of said plurality of upper slats and each of said plurality of lower slats;

wherein said upper slat assembly and said lower slat assembly form longitudinally aligned pairs of said upper and lower slats and each said longitudinally aligned pairs of upper and lower slats is independently operated via said head rail assembly and that within each said longitudinally aligned pairs of upper and lower slats, said upper and lower slats is synchronously rotated;

wherein, when each of said upper slats, said support rod and said control rod is held at a stationary position, said lower slats are manually rotated to an angle relative to said upper slats and said upper slats remain stationary;

wherein said supports rods are directly engaged to an outer surface of each said longitudinally aligned pairs of upper and lower slats, respectively; and, wherein said support rods remain exposed exterior of said outer surface of each said longitudinally aligned pairs of upper and lower slats, respectively.

11. The window covering of claim 10, wherein each of said plurality of upper and lower slats further comprises a linear panel having a slightly concaved profile.

12. The window covering of claim 10, wherein said each of said support rods is affixed to a rear side of each of said plurality of upper slats along a longitudinal center line thereof via a plurality of upper slat fasteners.

13. The window covering of claim 12, wherein each of said plurality of upper slat fasteners further comprises a capturing bracket monolithically formed with each of said plurality of upper slats.

14. The window covering of claim 10, wherein said each of said support rods is affixed to a rear side of each of said plurality of lower slats along a longitudinal center line thereof via a plurality of lower slat fasteners.

15. The window covering of claim 14, wherein said plurality of lower slat fasteners each further comprises a fastening block monolithically formed with each of said plurality of lower slats having a block aperture centrally located therethrough;

wherein each of said plurality of support rods are removably inserted within block aperture with a fastener, thereby enabling rotary motion of each of said plurality of lower slats when driven by said each of said plurality of support rods; and, wherein a fastener secures each of said lower slats at a desired rotary position.

16. The window covering of claim 10, wherein said head rail assembly further comprises:

a head rail frame, comprising an elongated enclosure having an open bottom and a slider rail;

a control rod slider slidably engaged within said slider rail;

a control rod connected to said control rod slider;

a gear drive mechanism operably controlled by said control rod slider;

a lateral drive mechanism operably controlled by said control rod slider;

a plurality of sliders slidably engaged within said slider rail and operably controlled by said lateral drive mechanism and said gear drive mechanism;

wherein said head rail frame is removably affixed to said window casing;

wherein said control rod provides a lateral sliding deployment of said plurality of support rods via said lateral drive mechanism;

wherein said control rod provides a rotating deployment of said plurality of support rods via said gear drive mechanism; and, wherein each of said plurality of support rods are removably attached to each of said plurality of sliders via a support rod fastening means, thereby operably connecting said control rod to said upper slat assembly and said lower slat assembly.

17. The window covering of claim 16, wherein said support rod fastening means further comprises:

a support rod fastener affixed to and upwardly extending from an upper terminal end of each of said plurality of support rods, further comprising a centrally disposed slat fastener aperture; and, a slider fastener downwardly extending from each of said plurality of sliders, further comprising a bifurcated pair of locking tabs;

wherein said slider fastener correspondingly mates with said support rod fastener, thereby mating each of said plurality of support rods to each of said plurality of sliders.

18. The window covering of claim 16, wherein said support rod fastening means further comprises:

a support rod fastener monolithically formed and upwardly extending from an upper terminal end of each of said plurality of support rods, further comprising a centrally disposed slat fastener aperture; and, a slider fastener monolithically formed and downwardly extending from each of said plurality of sliders, further comprising a bifurcated pair of locking tabs;

wherein said slider fastener correspondingly mates with said support rod fastener, thereby mating each of said plurality of support rods to each of said plurality of sliders.

* * * * *